US011325163B2

(12) United States Patent
Polygerinos et al.

(10) Patent No.: US 11,325,163 B2
(45) Date of Patent: May 10, 2022

(54) SOFT INFLATABLE ACTUATORS FOR SORTING APPLICATIONS

(71) Applicants: Panagiotis Polygerinos, Gilbert, AZ (US); Saivimal Sridar, Mesa, AZ (US); Pham Huy Nguyen, Mesa, AZ (US)

(72) Inventors: Panagiotis Polygerinos, Gilbert, AZ (US); Saivimal Sridar, Mesa, AZ (US); Pham Huy Nguyen, Mesa, AZ (US)

(73) Assignee: Arizona Board of Regents on behalf of Arizona State University, Scottsdale, AZ (US)

( * ) Notice: Subject to any disclaimer, the term of this patent is extended or adjusted under 35 U.S.C. 154(b) by 105 days.

(21) Appl. No.: 16/579,399

(22) Filed: Sep. 23, 2019

(65) Prior Publication Data

US 2020/0094290 A1 Mar. 26, 2020

Related U.S. Application Data

(60) Provisional application No. 62/734,770, filed on Sep. 21, 2018.

(51) Int. Cl.
*B07C 5/36* (2006.01)

(52) U.S. Cl.
CPC ..... *B07C 5/362* (2013.01); *B07C 2501/0018* (2013.01)

(58) Field of Classification Search
CPC ..... B07C 5/362; B07C 2501/0018
USPC ..... 209/606
See application file for complete search history.

(56) References Cited

U.S. PATENT DOCUMENTS

2009/0173223 A1* 7/2009 Kudawara ..... F15B 15/103 92/92
2016/0235426 A1* 8/2016 Hirata ..... A61B 1/018
2017/0291806 A1* 10/2017 Lessing ..... B25J 9/1612
2017/0341238 A1* 11/2017 Lessing ..... F15B 15/103
2018/0289522 A1 10/2018 Zhu et al.
(Continued)

FOREIGN PATENT DOCUMENTS

WO WO2019183397 A1 9/2019

OTHER PUBLICATIONS

Kirby, R. S. et al. Prevalence and functioning of children with cerebral palsy in four areas of the United States in 2006: A report from the Autism and Developmental Disabilities Monitoring Network. Res. Dev. Disabil. 32, 462-469 (2011).
(Continued)

*Primary Examiner* — Terrell H Matthews
(74) *Attorney, Agent, or Firm* — Snell & Wilmer L.L.P.

(57) ABSTRACT

Systems and methods for sorting utilizing an inflatable actuator are disclosed. A sorting system utilizing an inflatable actuator includes an inflatable actuator. The inflatable actuator is disposed in a cantilever beam orientation atop a support surface. The system includes an inflation component coupled to the inflatable actuator to provide an inflation force. Additionally, the system includes a control component configured to send an activation signal to the inflation component responsive to a detection of an object to be sorted. Responsive to the activation signal, the inflation component inflates the inflatable actuator to cause the inflatable actuator to make contact with the object to be sorted. The contact of the inflatable actuator with the object to be sorted causes the object to change from a first trajectory to a second trajectory.

20 Claims, 4 Drawing Sheets

(56) References Cited

U.S. PATENT DOCUMENTS

| | | | |
|---|---|---|---|
| 2019/0029914 | A1 | 1/2019 | Polygerinos et al. |
| 2019/0167504 | A1 | 6/2019 | Polygerinos et al. |
| 2019/0247217 | A1 | 8/2019 | Govin et al. |
| 2019/0314980 | A1 | 10/2019 | Polygerinos et al. |
| 2019/0323645 | A1 | 10/2019 | Polygerinos et al. |
| 2019/0336315 | A1 | 11/2019 | Polygerinos et al. |
| 2020/0361095 | A1 | 11/2020 | Nguyen et al. |
| 2020/0376650 | A1 | 12/2020 | Polygerinos et al. |

OTHER PUBLICATIONS

Lubelski, D. et al. Correlation of quality of life and functional outcome measures for cervical spondylotic myelophathy. J. Neurosurg. Spine 24, 483-489 (2016).
Ajiboye, A.B. et al. Articles Restoration of researching and grasping movements through brain-controlled muscle stimulation in a person with tetraplegia : a proof-of-concept-demonstration. Lancet 6736, 1-10 (2017).
Bogue, R. Exoskeletons and robotic prosthetics: a review of recent developments. Ind. Robot An Int. J. 36, 421-427 (2009).
Gopura, R. A. R. C., Kiguchi, K. & Bandara, D.S.V. A brief reviewon upper extremity robotic exoskeleton systems a Brief Review on Upper Extremity Robotic Exoskeleton Systems. 8502, 346-251 (2015).
Parietti, F. & Asada, H.H. Supernumerary Robotic Limbs for aircraft fuselage assembly: Body stabilization and guidance by bracing. Proc.—IEEE Int. Conf. Robot. Autom. 1176-1183 (2014). doi: 10.1109/ICRA.2014.6907002.
Kurek, D.A. & Asada. H.H. The MantisBot: Design and Impedance of Control of Supernumerary Robotic Limbs for Near-Ground Work. 5942-5947 (2017).
Parietti, F., Chang, K. C., Hunter, B. & Asada. H.H. Design and control of Supernumerary Robotic Limbs for balance augmentation. Robot. Autom. (ICRA), 2015 IEEE Int. Conf. 5010-5017 (2015). doi: 10.1109/ICRA.2015.7139896.
Qureshi, A. H., Nakamura, Y., Yoshikawa, Y. & Ishiguro, H. Show, Attend and Interact: Perceivable Human-Robot Social Interaction through Neural Attention Q-Network. 1639-1645 (2017).
Wu, F.Y. & Asada, H.H. 'Hold-and-manipulate' with a single hand being assisted by wearable extra fingers. Proc.—IEEE Int. Conf. Robot. Autom. Jun. 2015, 6205-6212 (2015).
Wu, F. Y. & Asada, H.H. Implicit and Intuitive Grasp Posture Control for Wearable Robotic Fingers: A Data-Driven Method Using Partial Least Squares. IEEE Trans. Robot. 32, 176-186 (2016).
Tiziani, L. et al. Empirical characterization of modular variable stiffness inflatable structures for supernumerary grasp-assist devices 1-23 (2017). doi: 10.1177/0278364917714062.
Guterstam, A., Petkova, V.I. & Ehrsson, H.H. The Illusion of Owning a Third Arm. 6, (2011).
Tsakiris, M. & Carpenter, L. Hands only illusion: multisensory integration elicits sense of ownership for body parts but not for non-corporeal objects. 343-352 (2010). doi: 10.1007/S00221-009-2039-3.
Parietti, F. & Asada, H. H. Independent, Voluntary Control of Extra Robotic Limbs. 5954-5961 (2017).
Sasaki, T., Saraiji, M. Y., Fernando, C.L. Minamizawa, K. & Inami, M. MetaLimbs. ACS SIGGRAPH 2017 Posters—SIGGRAPH '17 1, 1-2 (2017).
Sada, M. Al, Khamis, M. & Kato, A. Challenges and Opportunities of Supernumerary Robotic Limbs. (2017).
Del-Alma, A.J. et al. Review of hybrid exoskeletons to restore gait following spinal cord injury. J. Rehabil. Res. Dev. 49, 497 (2012).
Polygerinos, P. et al. Soft Robotics: Review of Fluid-Driven Intrinsically Soft Devices; Manufacturing, Sensing, Control, and Applications in Human-Robot Interaction. Adv. Eng. Mater. e201700016-n/a doi:10.1002/adem.201700016.
Simpson, C.S., Okamura, A.M. & Hawkes, E.W. Exomuscle: An inflatable device for shoulder abduction support. 6651-6657 (2017).
Awad, L.N. et al. A soft robotic exosuit improves walking after stroke. Sci. Transl. Med. In Press, (2017).
Polygerinos, P. et al. Towards a soft pneumatic glove for hand rehabilitation. IEEE Int. Conf. Intell. Robot. Syst. 1512-1517 (2013). doi10.1109/IROS.2013.6696549.
Polygerinos, P. et al. Modeling of soft Fiber-Reinforced Bending Actuators. IEEE Trans. Robot. 31, 778-789.
Klute, G.K. Czerniercki, J.M. & Hannaford, B. McKibben Artificial Muscles: Pneumatic Actuators with Biomedical Intelligence. 1-6 (1999).
Niiyama, R., Rus, D. & Kim, S. Pouch Motors : Printable / Inflatable Soft Actuators for Robotics. 6332-6337 (2014).
McMahan, W., Jones, B.A. & Walker, I.D. Design and implementation of a multi-section continuum robot: Air-octor. 2005 IEEE/RSJ Int. Conf. Intell. Robot. Syst. IROS 3345-3352 (2005). doi: 10.1109/IROS.2005.1545487.
Calisti, M. et al. An octopus-bioinspired solution to movement and manipulation for soft robots. Bioinspir. Biomim. 6, 36002 (2011).
Walker, I.D. et al. Continuum robot arms inspired by cephalopods. SPIE Conf. Unmanned Gr. Veh. Techol. 5804, 303-314 (2005).
Godage, I.S., Medrano-Cerda, G.A., Branson, D.T., Guglielmino, E. & Caldwell, D.G. Dynamics for variable length multisection continium arms. Int. J. Rob. Res. 35, 695-722 (2016).
Ansari, Y. et al. Towards the development of a soft manipulator as an assistive robot for personal care of elderly people. Int. J. Adv. Robot. Syst. 14, 1-17 (2017).
Sanan, S. Soft Inflatable Robots for Safe Physical Human Interaction. Carnegie Mellon Univ. 3575511, 240 (2013).
Hawkes, E. W., Blumensch, L.H., Greer, J.D. & Okamura, A.M.A. soft robot that navigated its environment through growth. 1-8 (2017).
Best, B.C.M. et al. A New Soft Robot Control Method. 75-84 (2016).
Cianchetti, M. et al. STIFF-FLOP Surgical Manipulator: mechanical design an experimental characterizations of the single module. 3576-3581 (2013).
Marchese, A.D. & Rus, D. Design, kinematics, and control of a soft spatial fluidic elastomer manipulator. Int. J. Rob. Res. 02783649155587925.
Nguyen, P.H., Sridar, S., Zhang, W. & Polygerinos, P. Design and Control of a 3-Chambered Fiber Reinforced Soft Actuator with Off-the-shelf Stretch Senors Int. J. Intell. Robot. Appl. to appear, (2017).
Plagenhoef, S., Evans F.G. & Abdelnour, T. anatomical Data for Analyzing Human Motion. Res. Q. Exerc. Sport 54,169-178 (1983).
Kier, W.M. & Smith, K.K. The biomechanics of movement in tongues and tentacles. J. Biomech. 16, 292-293 (1983).
Charles, J.P., Cappellari, O., Spence, A.J., Hutchinson, J.R. & Wells, D.J. Musculoskeletal geometry, muscle architecture and functional specialisations of the mouse hindlimb. PLoS One 11, 1-21 (2016).
Connolly, F., Walsh, C.J. & Bertoldi, K. Automatic design of fiber-reinforced soft actuators for trajectory matching. Proc. Natl. Acad. Sci. 201615140 (2016). doi: 10.1073/pnas. 1615140114.
Bishnop-Moser, J. & Kota, S. Design and Modeling of Generalized Fiber-Reinforced Pneumatic Soft Actuators. IEEE Trans. Robot. 31, 536-546 (2015).
Deimel, R. & Brock, O. A complaint hand based on a novel pneumatic actuator. Proc.—IEEE Int. Conf. Robot. Autom. 2047-20533 (2013). doi:10.1109/ICRA.2013.6630851.
Agarwal, G., Besuchnet, N., Audergon, B. & Paik, J. Stretchable Materials for Robust Soft Actuators towards Assistive Wearable Devices. Nat. Publ. Gr. 1-8 (2016). doi:10.1038.srep34224.
Connolly, F., Polygerinos, P., Walsh, C.J. & Bertoldi, K. Mechanical Programming of Soft Actuators by Varying Fiber Angle. Soft Robot. 2, 26-32 (2015).
Yeoh, O.H. Some Forms of the Strain Energy Function for Rubber. Rubber Chemistry and Technolgy 66, 754-771 (1993).
Maria Elena Giannaccini, Chaoqun Xiang, Adham Atyabi, Theo Theodoridis, Samia Nefti-Meziani, Steve Davis, Giannaccini Maria Elena, Xiang Chaoqun, Atyabi Adham, Theodoridis Theo, Nefti-Meziani Samia, and Davis Steve. Novel Design of a Soft Light-

(56) References Cited

OTHER PUBLICATIONS weight Pneumatic Continuum Robot Arm with Decoupled Variable Stiffness and Positioning. Soft Robotics, 00(00):soro.2016.0066, 2017.

Moseley, P. et al. Modeling, Design, and Development of Soft Pneumatic Actuators with Finite Element Method. Adv. Eng. Mater. 18, 978-988 (2016).

Vighnesh Vatsal and Guy Hoffman. Wearing Your Arm on Your Sleeve: Studying Usage Contexts for a Wearable Robotic Forearm. In 2017 IEEE International Symposium on Robot and Human Interactive Communication (RO-MAN), pp. 974-980, Aug. 2017.

Irfan Hussain, Gionata Salvietti, Giovanni Spanoletti, Monica Malvezzi, David Cioncoloni, Simone Rossi, and Domenico Prattichizzo. A soft supernumerary robotic finger and mobile arm support for graping compensation and hemiparetic upper limb rehabilitation. Robotics and Autonomous Systems, 93:1-12, 2017.

W. Zhang and P Polygerinos. Distributed planning of multi-segment soft robotic arms. In 2018 Annual American Control Conference (ACC), pp. 2096-2101, Jun. 2018.

Matthew A Robertson and Jamie Paik. New soft robots really suck: Vacuum-powered systems empower diverse capabilities. Science Robotics, 2(9):1-12, 2017.

Zheyuan Gong, Jiahui Cheng, Xingyu Chen, Wenguang Sun, Xi Fang, and Kainan Hu. A Bio-inspired Soft Robotic Arm : Kinematic Modeling and Hydrodynamic Experiments. Journal of Bionic Engineering, 15:204-219, 2018.

Junius Santoso, Erik H Skorina, Ming Luo, Ruibo Yan, and Cagdas D Onal. Design and analysis of an origami continuum manipulation module with torsional strength. In IEEE International Conference on Intelligent Robots and Systems, vol. 2017—Septe, pp. 2098-2104, 2017.

Ohta Preston, Valle Luis, King Jonathan, Low Kevin, Yi Jaehyun, Atkeson Christopher G., Park Yong-Lae, Preston Ohta, Luis Valle, Johnathan King, Kevin Low, Jaehyun Yi, Christopher G. Atkeson, and Yong-Lae Park. Design of a Lightweight Soft Robotic Arm Using Pneumatic Artificial Muscles and Inflatable Sleeves. Soft Robotics, 0(0): null, 2017.

Xianquan Liang, Haris Cheong, Yi Sun, Jin Guo, Chee Kong Chui, and C Yeow. Design, Characterizations and Implementation of a Two—DOF Fabric—basd Soft Robotic Arm. IEEE Robotics and Automation Letters, 3766(c):1-8, Jul. 2018.

Masashi Takeichi, Koichi Suzumori, Gen Endo, and Hiroyuki Nabae. Development of Giacometti Arm With Ballon Body. IEEE Robotics and Automation Letters, 2(2):2710-2716, 2017.

Hye Jong Kim, Akihiro Kawamura, Yasutaka Nishioka, and Sadao Kawamura. Mechanical design and control of inflatable robotic arms for high positioning accuracy. Advanced Robotics, 32(2):89-104, 108.

Xianquan Liang, Hong Kai Yap, J Guo, R C H Yeow, Y Sun, and C K Chui. Design and characterizations of a novel fabric-based robotic arm for future wearable robot application. In 2017 IEEE International Conference on Robotics and Biomimetrics (ROBIO), pp. 367-372, Dec. 2017.

Pham Huy Nguyen, Curtis Sparks, Sai Gautham Nuthi, Nicholas M Vale, and Panagiotis Polygerinos. Soft Poly-Limbs: Towards a New Paradigm of Mobile Manipulation for Daily Living Tasks. Soft Robotics, 00(00):soro.2018.0065, 2018.

Carly M. Thalman, Quoc P. Lam, Pham H. Nguyen, Saivimal Sridar, and Panagiotis Polygerinos. a Novel Soft Elbow Exosuit to Supplement Bicep Lifting Capacity. In 2018 IEEE/RSJ International Conference on Intelligent Robots and Systems, IROS, 2018. [Accepted].

* cited by examiner

SOFT INFLATABLE ACTUATORS FOR SORTING APPLICATIONS

CROSS-REFERENCE TO RELATED APPLICATION

This application claims priority to, and the benefit of, U.S. Provisional Application Ser. No. 62/734,770 filed on Sep. 21, 2018, and entitled "SOFT INFLATABLE ACTUATORS FOR SORTING APPLICATIONS." The above application is hereby incorporated by reference in its entirety.

TECHNICAL FIELD

The present disclosure relates to industrial processing, and in particular to soft inflatable actuators suitable for performing various tasks, such as materials sorting.

BACKGROUND

Prior sorting systems, for example pneumatic piston actuators, have suffered from various drawbacks, including limitations due to high cost, limited life cycle, propensity for damaging items being sorted, and difficulty and expense to repair. Accordingly, improved sorting systems remain desirable.

SUMMARY

Systems, methods, and devices for sorting utilizing an inflatable actuator are disclosed. In an exemplary embodiment, a sorting system utilizing an inflatable actuator may include an inflatable actuator. The inflatable actuator may be disposed in a cantilever beam orientation atop a support surface. The system may include an inflation component coupled to the inflatable actuator to provide an inflation force. Additionally, the system may include a control component configured to send an activation signal to the inflation component responsive to a detection of an object to be sorted. Responsive to the activation signal, the inflation component may inflate the inflatable actuator to cause the inflatable actuator to make contact with the object to be sorted. The contact of the inflatable actuator with the object to be sorted may cause the object to change from a first trajectory to a second trajectory.

In an exemplary embodiment, a method for sorting objects may include detecting, in a conveying system, an object to be sorted from a first trajectory to a second trajectory. The method may also include transmitting, from a control component to an inflation component coupled to an inflatable actuator, a control signal to cause the inflation component to transmit an inflation substance to the inflatable actuator. Additionally, the method may include inflating, by the inflation component, the inflatable actuator to bring the inflatable actuator into contact with the object to be sorted to cause the object to transition from a first trajectory to a second trajectory different from the first trajectory.

BRIEF DESCRIPTION OF THE DRAWINGS

With reference to the following description and accompanying drawings.

DETAILED DESCRIPTION

The following description is of various exemplary embodiments only and is not intended to limit the scope, applicability, or configuration of the present disclosure in any way. Rather, the following description is intended to provide a convenient illustration for implementing various embodiments, including the best mode. As will become apparent, various changes may be made in the function and arrangement of the elements described in these embodiments without departing from principles of the present disclosure.

For the sake of brevity, conventional techniques for robotics, automated sorting, or both, including actuators, joints, power, control, a combination of these, or the like may not be described in detail herein. Furthermore, the connecting lines shown in various figures contained herein are intended to represent exemplary functional relationships, physical couplings between various elements, or both. It should be noted that many alternative or additional functional relationships or physical connections may be present in a soft actuator sorting system, components thereof, or both.

Principles of the present disclosure contemplate the use of soft inflatable actuators for use in connection with sorting processes. Prior approaches for sorting, for example sorting of high-volume products such as vegetables on a conveyor belt, typically involve the use of pneumatically driven actuators that remove undesirable products from the belt. These actuators are fabricated using mechanical components that are expensive, have limited life cycle, may have a propensity to damage the items to be sorted, and are hard to repair. For example, current setups in high volume sorting utilize actuators that perform a "flicking" motion to segregate the desirable products from the undesirable ones. These actuators typically include a mechanical assembly made up of a rigid link attached to a single-acting (spring-loaded) pneumatically actuated piston which actuates rapidly upon detection of a target. The rapid actuation of the piston to perform the flicking motion may damage the product being sorted or may rapidly deteriorate the piston or other components. These components may be difficult to repair or have other issues as described herein.

Figure 1:
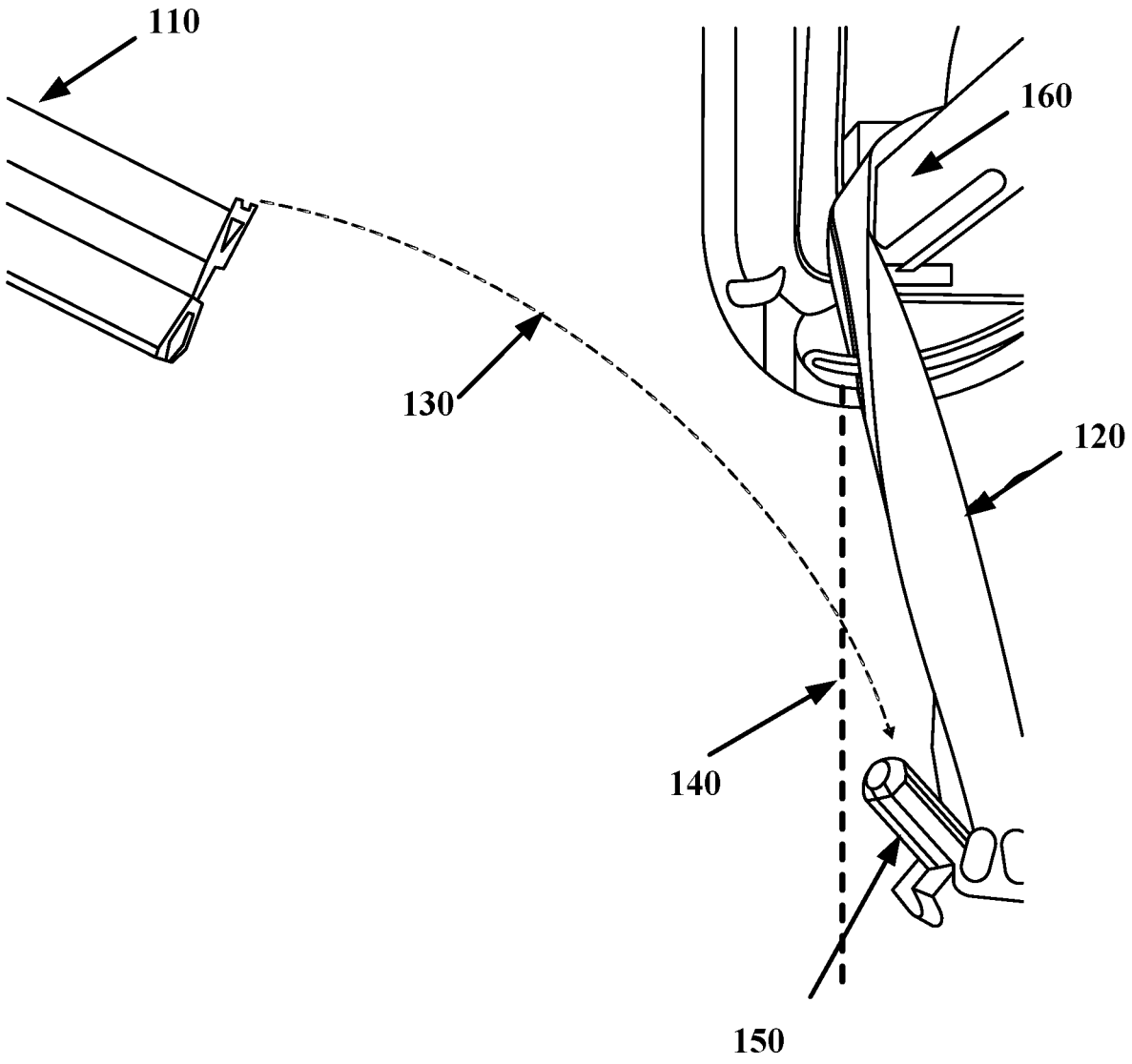
FIG. 1 illustrates use of an exemplary inflatable actuator system, wherein an actuator is not inflated, and thus an object is sorted into a first trajectory, in accordance with an exemplary embodiment.
Figure 2:
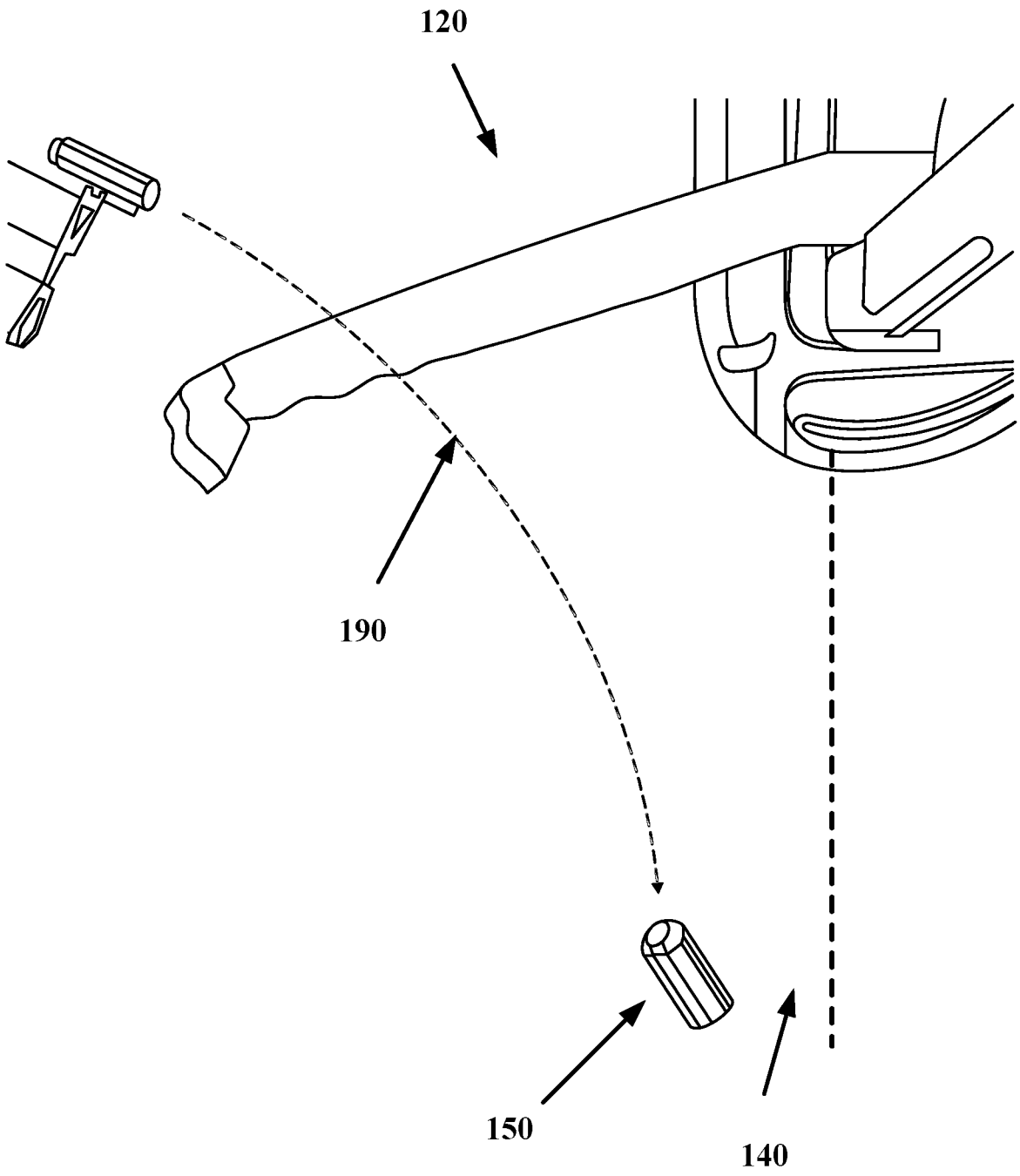
FIG. 2 illustrates the use of the exemplary inflatable actuator system of FIG. 1, wherein an actuator is inflated to cause an object to be sorted into a second trajectory different from the first trajectory, in accordance with an exemplary embodiment.

In order to remedy these and other deficiencies of prior approaches, exemplary inflatable actuator systems may be utilized. FIG. 1 illustrates the use of an exemplary inflatable actuator system 100. The exemplary inflatable actuator system 100 includes a track 110 and an inflatable actuator 120. In the illustrated example of FIG. 1, the inflatable actuator 120 is not inflated. Accordingly, an object, such as a pellet 150, may be sorted into a first trajectory 130, e.g., beyond a separation line 140 in accordance with an exemplary embodiment. The exemplary inflatable actuator system 100 of FIG. 1 forms a sorting system utilizing the inflatable actuator 120. The inflatable actuator 120 may be disposed in a cantilever beam orientation atop a support surface 160. The exemplary inflatable actuator system 100 includes an inflation component 170 coupled to the inflatable actuator to provide an inflation force. Additionally, the system includes a control component 180 configured to send an activation signal to the inflation component responsive to a detection of an object to be sorted. Responsive to the activation signal, the inflation component 170 inflates the inflatable actuator 120 to cause the inflatable actuator 120 to contact the object to be sorted, e.g., pellet 150. The contact of the inflatable actuator 120 with the object to be sorted causes the object to change from a first trajectory 130 to a second trajectory 190 (FIG. 2). The inflatable actuator 120 may be inflated by an inflation substance such as a gas, e.g., air, nitrogen, another gas or a mix of gasses; or a liquid, e.g., water, or other liquid; or mixture of liquid to the inflatable actuator 120. In another example embodiment, the inflation substance may be a mix of one or more gasses and one or more liquids.

FIG. 2 illustrates use of the exemplary inflatable actuator system 100 of FIG. 1. The inflatable actuator 120 is inflated in FIG. 2. Accordingly, the inflatable actuator 120 may cause an object, e.g., pellet 150, to be sorted into a second trajectory 190 different from the first trajectory 130, in accordance with an exemplary embodiment. The second trajectory may be "before" the separation line 140. Recall that the first trajectory may be "after" the separation line 140. Thus, the first trajectory 130 may be different from the second trajectory 190.

In the illustrated example of FIGS. 1-2, the inflation component 170 and the control component 180 are generally co-located adjacent to the inflatable actuator 120. It will be understood that one or more of the inflation component 170 and the control component 180 may be located away from the inflatable actuator 120. For example, the inflation component 170 may be co-located adjacent to the inflatable actuator 120 and receive control signals from the control component 180 over some distance. Alternatively, both the inflation component 170 and the control component 180 may be located away from the inflatable actuator 120. Accordingly, the inflation component 170 may transmit or convey an inflation material, e.g., gas, liquid, or mixture of gas and liquid, to the inflatable actuator 120. The inflation component 170 and the control component 180 may, in such as example, be co-located or remote from each other.

With reference now to FIG. 1 and FIG. 2, principles of the present disclosure allow for a low-cost solution to the problems of prior approaches for sorting, such as expense, limited life cycle, propensity for damage of the sorted objects, and repair difficulty discussed above as well as other problems of prior approaches for sorting. The principles of the present disclosure may utilize soft-inflatable actuators for replacing the existing mechanical actuators. Exemplary soft-inflatable actuators 120 may be fabricated from heat-sealable materials encased in inextensible or non-extendable fabric that stiffen up and create a recoil motion (flicking motion) upon application of pressure (e.g., using a gas or liquid). Via activation of one or more actuators, a desired object, for example a pellet 150, may be routed into a desired path or trajectory. It will be understood that the pellet 150 discussed throughout the specification is an example of an object that may be sorted. The systems and methods described herein may be used to sort other objects, including but not limited to fruit, vegetables, packages, parts, or practically any other sortable item that may travel on a conveyer, conveyer belt, track, or any other means of conveyance that may be used for sorting.

Exemplary soft-inflatable actuators 120 may be configured to perform a similar flicking action as prior mechanical actuators. Because the inflatable actuators 120 may be soft, at least when deflated, during at least a portion of the inflation, or both when deflated and during at least a portion of the inflation, the flicking action of the inflatable actuators 120 may be less likely to cause damage to items to be sorted.

In exemplary embodiments, various materials that are elastic and melt-processable may be used to form a soft-inflatable actuator 120. For example, soft-inflatable actuators 120 may be fabricated from suitable materials, for example heat-sealable film such as heat-sealed thermoplastic polyurethane material or any other type of heat sealable film such as polyester, PET, plastic film, or other heat-sealable films. The heat-sealable film may be encased in an inextensible fabric. The inextensible fabric may be any type of inextensible fabric. Examples of inextensible fabric include, but are not limited to, nylon fabric, polyester, rayon, or Kevlar, to name a few.

When an inflatable actuator 120 is in a resting (uninflated) state, the inflatable actuator 120 may be flexible and may exert very little or no force on objects, e.g., pellet 150, being sorted. For example, the pellet 150 may not contact the inflatable actuator 120 at all when the inflatable actuator 120 is not inflated. Alternatively, the pellet may slightly contact the inflatable actuator 120 when the inflatable actuator 120 is not inflated. For example, the pellet 150 may brush against the inflatable actuator 120. Furthermore, the inflatable actuator 120 may be in a different position, orientation, or both when the inflatable actuator 120 is inflated as compared to the position, orientation, or both of the inflatable actuator 120 when the inflatable actuator 120 is uninflated. Accordingly, the pellet 150 may still be directed in a different direction even if the pellet 150 contacts the uninflated inflatable actuator 120.

Because the inflatable actuator 120 exerts little or no force on the pellet, the inflatable actuator 120 may be effectively fully compliant to external disturbances. Upon the application of rapid internal pressurization, the inflatable actuator 120 may take up or assume a stiffened state. The inflatable actuator 120 may have a cross-section defined by the size and weight of the goods desired to be sorted. Accordingly, the inflatable actuator 120 may alter the trajectory of the pellet 150 when the pellet heads towards the inflatable actuator 120 by exerting an impact force.

Based on the specific sorting needs, the inflatable actuator 120 may be placed in different starting or resting angles. For example, the inflatable actuator 120 may be placed in a cantilever beam orientation. In a cantilever beam orientation, the inflatable actuator 120 may be fixed at one end and supported midway along the inflatable actuator 120 using another surface or fixture. In such setups, the unsupported part of the inflatable actuator 120 may be under the influence of gravity and may hang freely when uninflated.

When rapidly inflated, the inflatable actuator 120 stiffens and straightens out to a new orientation with respect to the ground plane while performing a forceful swinging/flicking motion. The swinging/flicking motion may impact the object, e.g., pellet 150, that comes in contact with the inflatable actuator 120 (for example, as illustrated in FIG. 2). Variations of impact angle, size, and shape of the inflatable actuator 120, the required pressure or pressure used by the inflatable actuator 120, the actuation speeds of the inflatable actuator 120, and the retracting of the inflatable actuator 120 to the resting position, may be defined based on attributes of the goods to be sorted. For example, the type of goods to be sorted, the size of the goods to be sorted, the shape of the goods to be sorted, the velocity of the goods to be sorted, or other attributes of the goods to be sorted may all influence selection of impact angle, size, and shape of the inflatable actuator 120, as well as the required pressure or pressure used by the inflatable actuator 120, the actuation speeds of the inflatable actuator 120, and the retracting of the inflatable actuator 120 to the resting position. Velocity of the goods may be a function of one or more of the velocity of the goods as the goods travel along the conveyer, conveyer belt, or track, and any change in velocity due to the goods losing altitude prior to impacting the inflatable actuator 120. For example, as illustrated in FIGS. 1-2, the pellet 150 falls from the track 110. Accordingly, the pellet 150 may generally change velocity as the pellet 150 falls from the track 110. Not only will speed of the pellet 150 increase, but the direction of travel of the pellet 150 may also change.

In one exemplary embodiment, the inflatable actuator 120 may be fabricated as discussed above with a diameter of about 1.2 cm and a length of about 15 cm. The inflatable actuator 120 may be mounted in a cantilever beam orientation, fixed at the midpoint. On the application of an instantaneous internal pressure of about 300 kPa, the overhung inflatable actuator 120 overcomes gravity, performing a flicking motion to impart a force to an object or objects in inflatable actuator 120's path. This exemplary embodiment of the inflatable actuator 120 may be sized to sort cylindrical pellets having a diameter of about 1.5 cm, length of about 3.5 cm, and mass of about 20 grams. It will be appreciated that various embodiments of inflatable actuator 120 may be sized, scaled, or both sized and scaled to accommodate various sizes, shapes, and masses of objects to be sorted. For example, the inflatable actuator 120 may be fabricated with a diameter of between about 0.75 cm and about 10 cm. Moreover, the inflatable actuator may be fabricated with a length of between about 5 cm and about 50 cm.

It will be appreciated that exemplary inflatable actuators 120 may be used stand-alone (i.e., a single inflatable actuator 120) or in combination with multiple inflatable actuators 120. Inflatable actuators 120 may be utilized, for example, in connection with a conveyor belt, machine vision systems, temperature sensors, RFID systems, a combination of these or the like, to identify objects (for example, pellets 150) for sorting, for example based on an unacceptable/acceptable (pass/fail) criteria approach. Alternatively, inflatable actuators 120 may be utilized in connection with graded approaches whereby items meeting a first grade may be sorted by a first actuator (e.g., the inflatable actuator 120) and/or into a first trajectory, and items meeting a second grade may be sorted (by a first actuator 120, a second actuator 120, and/or the like) into a second trajectory, and so forth.

As compared to prior approaches for sorting, the exemplary inflatable actuator 120 based systems may utilize fewer mechanical moving components, have low cost, may be easy to replace, may have low maintenance cost, may take less time to maintain, and may be compatible with current industrial setups.

In an example embodiment, the inflatable actuator 120 may be tapered. For example, the inflatable actuator 120 may become gradually narrower or thinner toward one end of the inflatable actuator 120. In one example, the distal end may be narrower or thinner. In another example embodiment, the proximal end may be narrower or thinner. In yet another example embodiment, the tapering may run perpendicular to the long axis of the inflatable actuator 120. Accordingly, the inflatable actuator 120 may form a flatter surface, rather than a rounded surface, in such an example.

In an example embodiment, the inflatable actuator 120 has at least one of a circular, ovoid, rectangular, triangular, or superellipse (squircle) cross-section. For example, in an embodiment, the inflatable actuator 120 may have a circular or generally circular cross-section. The cross-section may be defined by cross-section that is generally equidistant or approximately equidistant from a central point within the cross-section of the inflatable actuator 120. In an example embodiment, the inflatable actuator 120 may have an ovoid or approximately ovoid cross-section such that the cross-section may generally be egg-shaped. In another example embodiment, the inflatable actuator 120 may have a rectangular or approximately rectangular cross-section. In an example embodiment, the inflatable actuator 120 may have a triangular cross-section. In another example embodiment, the inflatable actuator 120 may have a superellipse (squircle) cross-section.

A superellipse is a closed curve resembling an ellipse, retaining the geometric features of semi-major axis and semi-minor axis, and symmetry about them, but having a different overall shape from an ellipse. The set of all points (x, y) in the Cartesian coordinate system that from a superellipse satisfy the equation:

$$\left|\frac{x}{a}\right|^n + \left|\frac{y}{b}\right|^n = 1,$$

where n, a, and b are positive numbers, and the vertical bars | | around a number indicate the absolute value of the number.

A squircle is a shape intermediate between a square and a circle. There are at least two definitions of "squircle" in use, the most common of which is based on the superellipse. Another example of a squircle may be the Fernández-Guasti squircle. As used herein, "superellipse (squircle)" may refer to the first definition based on the superellipse. However, in another example embodiment, the inflatable actuator 120 may have a Fernández-Guasti squircle shape. Furthermore, the shapes listed for the inflatable actuator 120 are only intended to be examples. It will be understood that the inflatable actuator 120 may come in almost any shape that a tube (or other sealed or sealable shape) of heat-sealable film or other substances may be formed into as long as that shape may be encased in an inextensible fabric.

Generally, the shape of the inflatable actuator 120 may be a function of what is being sorted, including the object to be sorted's size, shape, weight, velocity of travel, or any other physical attribute of the object to be sorted that may impact the inflatable actuator 120's ability to sort the object. In other words, the inflatable actuator 120 may be tailored to the objects being sorted.

As discussed above with respect to FIGS. 1-2, in an example embodiment, the inflatable actuator 120 is disposed in a cantilever beam orientation. A cantilever may be a structural element anchored at one end and generally supported out from the supported end and having an overhanging portion. Thus, in the cantilever beam orientation, when inactive, an overhanging end of the inflatable actuator 120 may hang vertically. When active, the overhanging end of the inflatable actuator 120 may extend horizontally, approximately horizontally, or may extend in some other fashion rather than vertically based on the design of the inflatable actuator 120.

In another example embodiment, an inflatable actuator may be supported from an end only. Thus, when inactive, virtually all or at least a substantial portion of the inflatable actuator may hang vertically. (For example, as may occur if the cantilever support is removed in FIGS. 1-2.) When active, the inflatable actuator may extend horizontally, approximately horizontally, or may extend in some other fashion rather than vertically based on the design of the inflatable actuator.

Figure 3:
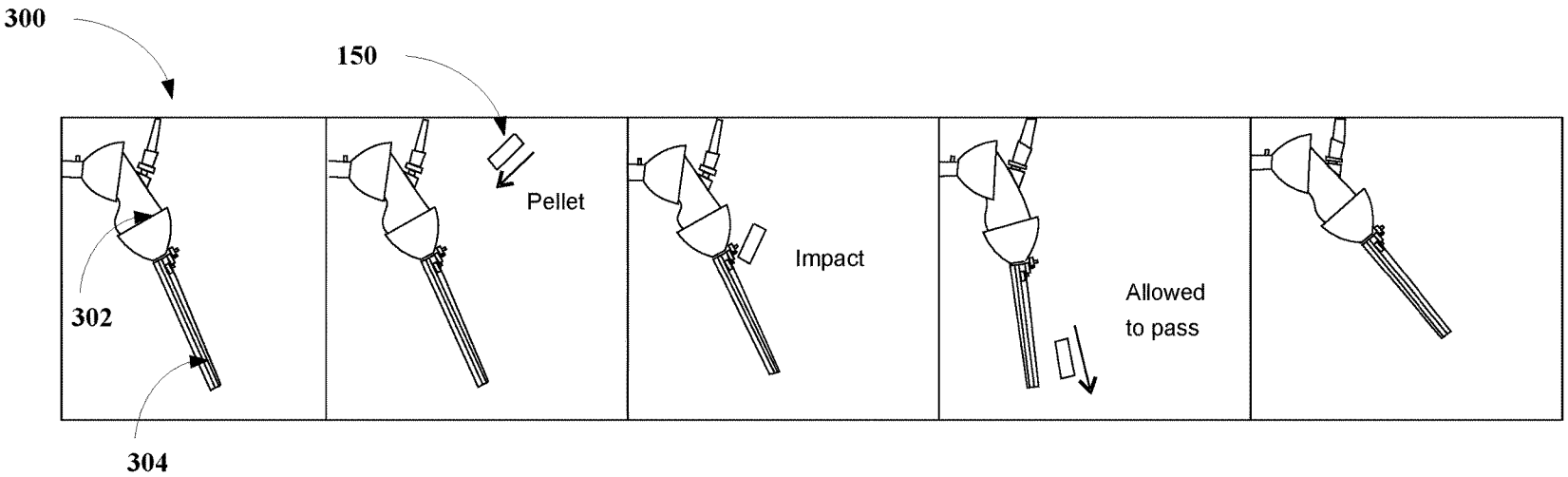
FIG. 3 illustrates use of an exemplary inflatable actuator system having a combination of compliant and rigid materials, wherein an actuator is not inflated, and thus an object is sorted into a first trajectory, in accordance with an exemplary embodiment.

FIG. 3 illustrates use of an exemplary inflatable actuator system 300 having a combination of compliant and rigid materials. An actuator 302 in FIG. 3 is not inflated. Accordingly, an object, e.g., pellet 150, may be sorted into a first trajectory, in accordance with an exemplary embodiment. FIG. 3 includes a series of diagrams illustrating that the object, e.g., pellet 150, may be sorted into the first trajectory, e.g., by an impact of the paddle at a first angle. Because the actuator 302 is not inflated, the change in trajectory of the object may be small or minimal. In another example, the object may not impact the paddle 304 at all. Accordingly, the object may not change trajectory at all in such a case.

Figure 4:
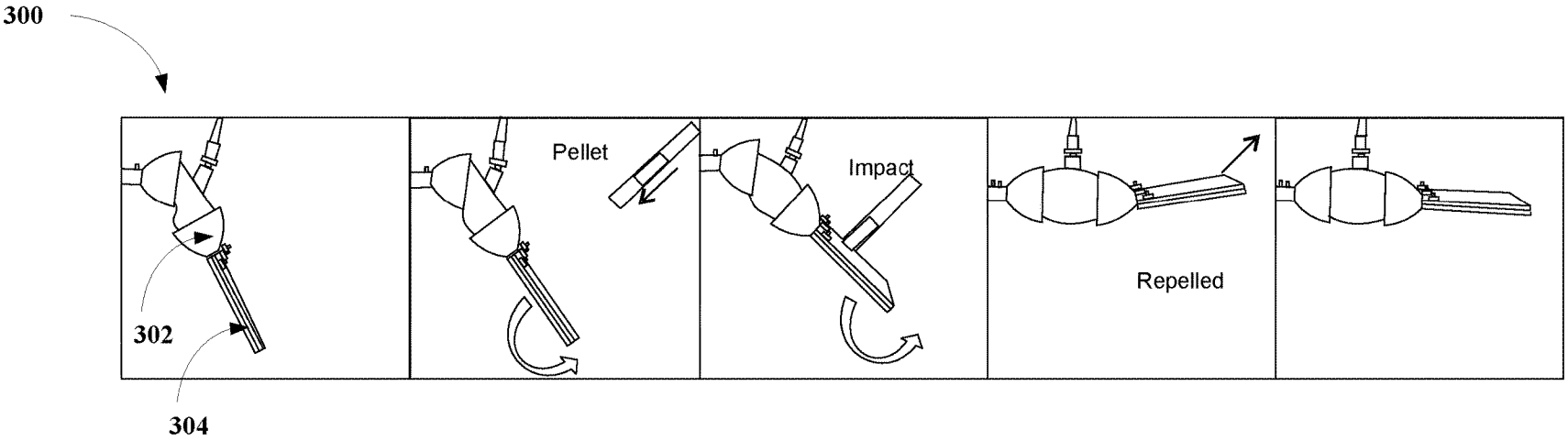
FIG. 4 illustrates the use of an exemplary inflatable actuator system of FIG. 3, wherein an actuator is inflated to cause an object to be sorted into a second trajectory different from the first trajectory, in accordance with an exemplary embodiment.

FIG. 4 illustrates the use of exemplary inflatable actuator system 300, wherein an actuator 302 is inflated to cause an object, e.g., pellet 150, to be sorted into a second trajectory different from the first trajectory, in accordance with an exemplary embodiment. For example, the actuator may push, repel, or flick away the object, e.g., pellet 150, when the actuator 302 is actuated. FIG. 4 includes a series of diagrams illustrating that the object, e.g., pellet 150, is sorted into the second trajectory, e.g., by an impact of the paddle at a second angle. Because the actuator 302 is inflated, the change in trajectory of the object may be larger or different from the change in trajectory of the object in FIG. 3. Furthermore, when the impact occurs, the paddle 304 may be moving. Accordingly, the impact may transfer momentum from the paddle 304 to the object.

Referring to FIGS. 3 and 4, in an example embodiment, the exemplary inflatable actuator system 300 for sorting may be a combination of compliant and rigid materials. For example, the exemplary inflatable actuator system 300 may include rigid materials forming a paddle 304. The exemplary inflatable actuator system 300 may also include compliant materials forming the actuator 302 that may be configured to move the paddle 304 when the actuator 302 is inflated. The compliant material may be any compliant material, including, but not limited to heat-sealable film such as heat-sealed thermoplastic polyurethane material, polyester, PET, plastic film, or any other heat-sealable film. The compliant material may be encased in an inextensible fabric, including, but not limited to nylon fabric, polyester, rayon, Kevlar, any other inextensible fabric, or the like.

As discussed above, FIGS. 3 and 4 present an example of the use of a soft-rigid hybrid mechanism to sort objects such as pellets 150. The exemplary embodiment may utilize a 3D-printed paddle attached to the ends of an inflatable actuator fabricated using TPU encased in fabric. It will be understood, however, that the paddle 304 may be manufactured using other manufacturing methods suitable for paddle manufacturing. Additionally, the paddle 304 may be made from plastic, metal, wood, or any other materials having an appropriate rigidity to perform a sorting function and capable of attachment to the actuator 302.

While FIG. 3 illustrates the compliance of the soft-rigid hybrid actuator 302 that allows cylindrical pellets 150 to pass through and FIG. 4 illustrates the actuator pushing away the pellet 150 to sort the incoming pellets, it will be understood that the exemplary inflatable actuator system 300 may be used to sort other objects, including, but not limited to fruit, vegetables, packages, parts, or practically any other sortable item that may travel on a conveyer, conveyer belt, track, or any other means of conveyance that may be used for sorting.

Furthermore, the paddle 304, the soft-rigid hybrid actuator 302, or both the paddle 304 and the soft-rigid hybrid actuator 302 of the exemplary inflatable actuator system 300 may be configured to sort the other objects. As discussed above, with respect to other example embodiments, variations of impact angle, size, and shape of the soft-rigid hybrid actuator 302, the required pressure or pressure used by the soft-rigid hybrid actuator 302, the actuation speeds of the soft-rigid hybrid actuator 302, and the retracting of the soft-rigid hybrid actuator 302 to the resting position, may be defined based on attributes of the goods to be sorted. For example, the type of goods to be sorted, the size of the goods to be sorted, the shape of the goods to be sorted, the velocity of the goods to be sorted, or other attributes of the goods to be sorted may all influence selection of impact angle, size, and shape of the soft-rigid hybrid actuator 302, as well as the required pressure or pressure used by the soft-rigid hybrid actuator 302, the actuation speeds of the soft-rigid hybrid actuator 302, and the retracting of the soft-rigid hybrid actuator 302 to the resting position. Furthermore, the type of goods to be sorted, the size of the goods to be sorted, the shape of the goods to be sorted, the velocity of the goods to be sorted, or other attributes of the goods to be sorted or some combination of these may also influence selection of the size, shape, material, other attributes of the paddle 304.

Figure 5:
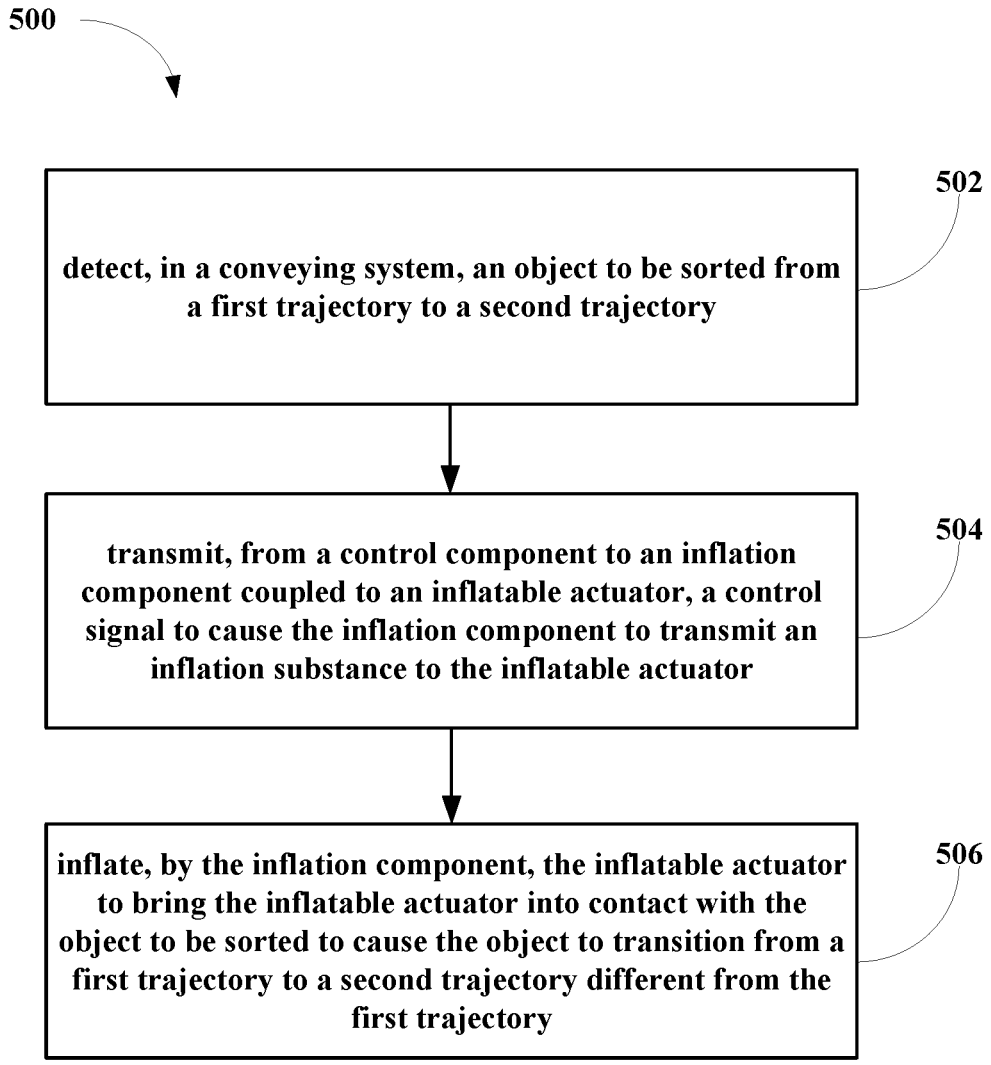
FIG. 5 illustrates a method for use of an exemplary inflatable actuator system in accordance with an exemplary embodiment.

FIG. 5 illustrates a method 500 for use of an exemplary inflatable actuator system in accordance with an exemplary embodiment, such as the exemplary inflatable actuator system 100 of FIG. 1. The example method for sorting objects includes detecting, in a conveying system, an object to be sorted from a first trajectory to a second trajectory (step 502). The example method for sorting objects also includes transmitting, from a control component to an inflation component coupled to an inflatable actuator, a control signal to cause the inflation component to transmit an inflation substance to the inflatable actuator (step 504). Additionally, the example method for sorting objects includes inflating, by the inflation component, the inflatable actuator to bring the inflatable actuator into contact with the object to be sorted to cause the object to transition from a first trajectory to a second trajectory different from the first trajectory (step 506).

As discussed above, the example method for sorting objects, e.g., pellets 150, includes detecting, in a conveying system, an object to be sorted from a first trajectory 130 to a second trajectory 190 (step 502). Detecting in an example sorting system may include using machine vision systems, temperature sensors, RFID systems, object weight, a combination of these or the like, or any other automated or semi-automated inspection technique to identify objects (for example, pellets 150) for sorting, for example based on an unacceptable/acceptable (pass/fail) criteria approach to determine which objects to send along the first trajectory 130 or the second trajectory 190. The inspections may take place along a conveying system such as a conveyer belt, track, or any other type of mechanical handling equipment that moves materials from one location to another. Alternatively, inflatable actuators 120 may be utilized in connection with graded approaches whereby items meeting a first grade may be sorted by a first actuator (e.g., the inflatable actuator 120) and/or into a first trajectory, and items meeting a second grade may be sorted (by a first actuator 120, a second actuator 120, and/or the like) into a second trajectory, and so forth.

The example method for sorting objects may also include transmitting, from a control component 180 to an inflation component 170 coupled to an inflatable actuator 120, a control signal to cause the inflation component to transmit an inflation substance to the inflatable actuator (step 504). For example, the control component 180 may transmit a signal to an inflation component 170. The signal transmitted to the inflation component 170 may cause the inflation component 170 to transmit or convey an inflation substance such as a gas, e.g., air, nitrogen, another gas or a mix of gasses; or a liquid, e.g., water, or other liquid; or mixture of liquid to the inflatable actuator 120. In an example embodiment, the inflation substance may be a mix of one or more gasses and one or more liquids.

Additionally, the example method for sorting objects includes inflating, by the inflation component 170, the inflatable actuator 120 to bring the inflatable actuator 120 into contact with the object to be sorted to cause the object to transition from a first trajectory to a second trajectory different from the first trajectory (step 506). For example, as discussed above, an inflation substance such as a gas, e.g., air, nitrogen, other gas or a mix of gasses; or liquid, e.g., water, or other liquid, or a mixture of liquids may be transmitted to the inflatable actuator 120. Accordingly, the inflatable actuator 120 may be inflated with the inflation substance, e.g., gas or liquid.

In an exemplary embodiment, the inflatable actuator may be disposed in a cantilever beam orientation atop a support surface, and wherein, when the inflatable actuator is uninflated, a portion of the inflatable actuator hangs off the support surface in a generally vertical orientation.

While the principles of this disclosure have been shown in various embodiments, many modifications of structure, arrangements, proportions, the elements, materials, and components, used in practice, which are particularly adapted for a specific environment and operating requirements may be used without departing from the principles and scope of this disclosure. These and other changes or modifications are intended to be included within the scope of the present disclosure.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, an electrical connection, a magnetic connection, an optical connection, a communicative connection, a functional connection, and/or any other connection. When language similar to "at least one of A, B, or C" or "at least one of A, B, and C" is used in the specification or claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A sorting system utilizing soft-rigid hybrid actuator, the system comprising:

the soft-rigid hybrid actuator comprising a compliant portion and a rigid portion, the soft-rigid hybrid actuator configured with an inactive state and an active state, the soft-rigid hybrid actuator disposed in a cantilever beam orientation atop a support surface;

an inflation component coupled to the soft-rigid hybrid actuator to provide an inflation force; and a control component configured to send an inactive state activation signal to the inflation component responsive to a detection of an object to be sorted, wherein the rigid portion comprises a rigid paddle and the compliant portion comprises an inflatable compliant material, wherein the rigid paddle is coupled to a first end of the inflatable compliant material, wherein a second end of the inflatable compliant material is coupled to the support surface, wherein the rigid paddle is configured to rotate with respect to the support surface in response to the inflatable compliant material being inflated from the inactive state to the active state, wherein, in the inactive state of the soft-rigid hybrid actuator, an unsupported portion of the soft-rigid hybrid actuator hangs freely and uninflated, and wherein, responsive to the activation signal, the inflation component rapidly inflates the inflatable compliant material from the inactive state to the active state to cause the rigid paddle to make contact with the object to be sorted, and the contact of the rigid paddle with the object to be sorted causes the object to change from a first trajectory to a second trajectory.

2. The system of claim 1, wherein, when the inflatable compliant material is uninflated, a portion of the soft-rigid hybrid actuator hangs off the support surface in a generally vertical orientation.

3. The system of claim 2, wherein, when the inflatable compliant material is inflated, the portion of the soft-rigid hybrid actuator that extends past an end of the support surface moves away from the generally vertical orientation to make contact with the object to be sorted.

4. The system of claim 1, wherein the inflatable compliant material comprises a tube of heat-sealable film encased in an inextensible fabric.

5. The system of claim 1, wherein the inflatable compliant material comprises heat-sealable film encased in an inextensible fabric, and wherein the soft-rigid hybrid actuator is configured with a diameter of about 1.2 cm and a length of about 15 cm.

6. The system of claim 1, wherein the soft-rigid hybrid actuator is tapered.

7. The system of claim 1, wherein the soft-rigid hybrid actuator has at least one of a circular, ovoid, rectangular, triangular, or superellipse (squircle) cross-section.

8. A method for sorting objects, the method comprising:

detecting, in a conveying system, an object to be sorted from a first trajectory to a second trajectory;

transmitting, from a control component to an inflation component coupled to an soft-rigid hybrid actuator, a control signal to cause the inflation component to transmit an inflation substance to a compliant portion of the soft-rigid hybrid actuator;

rapidly inflating, by the inflation component, the compliant portion of the soft-rigid hybrid actuator to transition the soft-rigid hybrid actuator from an inactive state to an active state, the inactive state comprising an unsupported portion of the soft-rigid hybrid actuator hanging freely and uninflated; and in response to rapidly inflating the soft-rigid hybrid actuator, rotating a rigid paddle with respect to a support surface to bring the rigid paddle into contact with the object to be sorted to cause the object to transition from the first trajectory to the second trajectory different from the first trajectory.

9. The method of claim 8, wherein the soft-rigid hybrid actuator is disposed in a cantilever beam orientation atop a support surface, and wherein, when the compliant portion is uninflated, a portion of the soft-rigid hybrid actuator hangs off the support surface in a generally vertical orientation.

10. The method of claim 9, wherein, when the compliant portion is inflated, the portion of the soft-rigid hybrid actuator that extends past an end of the support surface moves away from the generally vertical orientation to cause the rigid paddle to make contact with the object to be sorted.

11. The method of claim 8, wherein the compliant portion comprises a tube of heat-sealable film encased in an inextensible fabric.

12. The method of claim 8, wherein the compliant portion comprises heat-sealable film encased in an inextensible fabric, and wherein the soft-rigid hybrid actuator is configured with a diameter of between 1 cm and 1.4 cm, and preferably 1.2 cm, and a length of between 14 cm and 16 cm.

13. The method of claim 8, wherein the inflatable soft-rigid hybrid actuator is tapered.

14. A control system for sorting objects, the control system comprising a processor configured to:

detect, in a conveying system, an object to be sorted from a first trajectory to a second trajectory;

transmit, from the control system to an inflation component coupled to a soft-rigid hybrid actuator, a control signal to cause the inflation component to transmit an inflation substance to a compliant portion of the soft-rigid hybrid actuator; and rapidly inflate, by the inflation component, the compliant portion of the soft-rigid hybrid actuator to transition the soft-rigid hybrid actuator from an inactive state to an active state, the inactive state comprising an unsupported portion of the soft-rigid hybrid actuator hanging freely and uninflated, to cause a rigid paddle to perform a swinging motion and bring the rigid paddle into contact with the object to be sorted to cause the object to transition from the first trajectory to the second trajectory different from the first trajectory;

wherein the rigid paddle is coupled to a first end of the compliant portion of the soft-rigid hybrid actuator, wherein a second end of the compliant portion is coupled to a support surface, and wherein the rigid paddle rotates with respect to the support surface in response to the compliant portion being inflated from the inactive state to the active state.

15. The control system of claim 14, wherein the soft-rigid hybrid actuator is disposed in a cantilever beam orientation atop the support surface, and wherein, when the compliant portion is uninflated, a portion of the soft-rigid hybrid actuator hangs off the support surface in a generally vertical orientation.

16. The control system of claim 15, wherein, when the compliant portion is inflated, the portion of the soft-rigid hybrid actuator that extends past an end of the support surface moves away from the generally vertical orientation to cause the rigid paddle to make contact with the object to be sorted.

17. The control system of claim 14, wherein the compliant portion comprises a tube of heat-sealable film encased in an inextensible fabric.

18. The control system of claim 14, wherein the compliant portion comprises heat-sealable film encased in an inextensible fabric, and wherein the soft-rigid hybrid actuator is configured with a diameter of 1.2 cm and a length of 15 cm.

19. The control system of claim 14, wherein the soft-rigid hybrid actuator is tapered.

20. The system of claim 1, wherein the compliant portion extends along a first dimension of a total length of the soft-rigid hybrid actuator and the rigid portion extends along a second dimension of the total length of the soft-rigid hybrid actuator.

* * * * *